United States Patent [19]

Dolan

[11] 4,435,858

[45] Mar. 13, 1984

[54] AUTOMATIC TOILET BOWL CLEANING DEVICE

[76] Inventor: John E. Dolan, 15 New Main St., Haverstraw, N.Y. 10927

[21] Appl. No.: 395,123

[22] Filed: Jul. 6, 1982

[51] Int. Cl.[3] ..... E03D 9/02

[52] U.S. Cl. ..... 4/228

[58] Field of Search ..... 4/227, 228, 222; 422/263; 222/478

[56] References Cited

U.S. PATENT DOCUMENTS

| | | | |
|---|---|---|---|
| 3,423,182 | 1/1969 | Klasky | 4/228 X |
| 3,769,640 | 11/1973 | Castronovo | 4/228 |
| 3,781,926 | 1/1974 | Levey | 4/228 |
| 3,867,101 | 2/1975 | Herring | 4/228 X |
| 4,277,853 | 7/1981 | McDuffee | 4/228 |
| 4,318,891 | 3/1982 | Kim | 4/227 X |
| 4,365,362 | 12/1982 | Corey | 4/227 X |

*Primary Examiner*—Charles E. Phillips
*Attorney, Agent, or Firm*—John F. Ohlandt

[57] ABSTRACT

An automatic toilet bowl cleaning device adapted to dispense water soluble solid disinfectant into the flushing water of the toilet tank, such device comprising a container for the disinfectant and a cover fitted on the container; the cover has a series of spaced holes or apertures extending through the top wall thereof and a series of spaced holes extending through the side wall, the total area of all of the latter holes being less than the total area of the former holes; and in which the former holes are arranged in the diametrically opposite half of the cover from the latter holes, whereby in operation, air is trapped momentarily in the head of the device creating a turbulence inside the container which provides a mixing action, thereby promoting the formation and dispensing of disinfectant solution.

5 Claims, 7 Drawing Figures

AUTOMATIC TOILET BOWL CLEANING DEVICE

BACKGROUND, OBJECTS AND SUMMARY OF THE INVENTION

This invention relates in general to a method and apparatus for cleansing, disinfecting, and de-odorizing a flushing toilet tank and toilet bowl each time the toilet is flushed.

The preferred automatic toilet bowl cleaning device of the present invention is in the form of a dispensing mechanism entirely passive in nature, that is, it has no moving parts. Moreover, such mechanism is highly reliable in operation, is readily moldable and extremely simple in construction, and therefore is inexpensive to manufacture.

A variety of toilet bowl cleaners have been known in the art and for a complete understanding of the features and advantages of the present invention, reference may be made by way of background material to the following patents and other references: U.S. Pat. Nos. 4,277,853, 4,318,891, and 3,781,926.

Basically, all of the cleaning devices described in the aforenoted patents comprise a container which is located within the water tank associated with a toilet bowl, and a disinfectant or cleaning compound included within the container. The disinfectant or cleaning compound inside the container takes the form of a more or less standard solid cake composed of urea, synthetic detergents, and blue dye. A plurality of openings provides exposure to water so the compound will be dissolved and thereby delivered to the bowl when the toilet is flushed.

Whatever the merits of these devices as described in the patents, they do not afford the advantages associated with the present invention. Moreover, from actual tests that have been conducted on commercially available toilet bowl cleaners, it has been found that their cleaning action is not consistent and in some circumstances (for example, due to cold water or low water pressure), they do not dispense at all.

It has been discovered that if the openings in the cover or closure for the cleaning device are suitably formed and disposed, then a far superior performance can be realized than is available from those devices now on the market. Test data is furnished hereinafter to support this claim.

Accordingly, it is a twin object of the present invention to provide an extremely simple toilet bowl cleaning device, yet one that will enable consistent dispensing of disinfectant material along with the blue dye material commonly used, so that there will be a consistent color of the water in the toilet bowl as an indicator of proper dispensing of the cleaning solution.

Accordingly, a primary feature of the present invention is in the context of a container structure which includes closed bottom and side walls for confining the cleaning compound and a cover which is fitted on the container. The significant aspect is that the cover is provided with a series of spaced holes extending through the top wall thereof, and a further series of spaced holes is provided extending through the side wall, the total area of all of the latter holes being less than the total area of the former holes, with the former holes arranged in the diametrically opposite half of the cover from the latter.

Other and further objects, advantages and features of the present invention will be understood by reference to the following specification in conjunction with the annexed drawing, wherein like parts have been given like numbers.

DESCRIPTION OF PREFERRED EMBODIMENT

Figure 4:
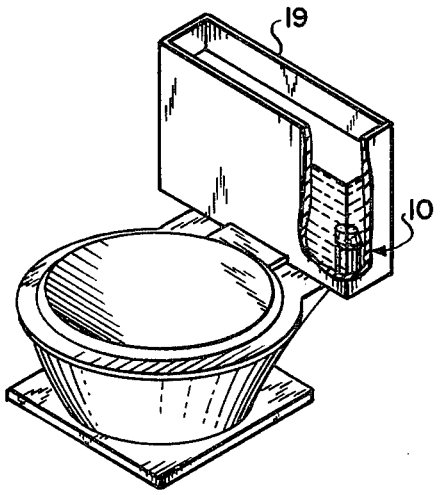
FIG. 4 is a perspective view of the cleaning device in use in a toilet tank.

Referring now to the figures of the drawing, there will be seen a cleaning device 10 comprising a container 12 which is suitably molded or otherwise formed in a cylindrical or cup-like shape. A cake 13 of cleaning compound is provided within container 12. Mounted by press fitting to the container 12 is a cover or closure 14 of frusto-conical shape. The container is provided with a suitable flange 16 adapted to be received in a groove 18 in a skirt portion 14A of cover 14. It will be understood, of course, that the device can be formed in other ways and that, as seen in FIG. 4, the device 10 is adapted to be placed at the bottom of a toilet tank 19 when in use.

Although the dimensions of the cleaning device 10 are not critical, the following approximate dimensions have been adopted in manufacturing an exemplary cleaning device in accordance with the present invention:

Total height of device: 4 15/16 inches high,
Diameter at the base: $2\frac{3}{4}$ inches
Diameter at the top: 2 7/16 inches.

Figure 1:
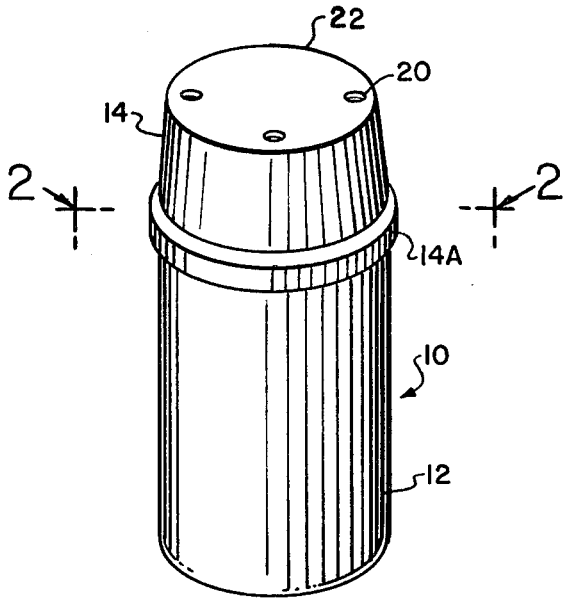
FIG. 1 is a perspective view of a toilet bowl cleaning device according to the invention, showing the container and the cover in place on the container.
Figure 3:
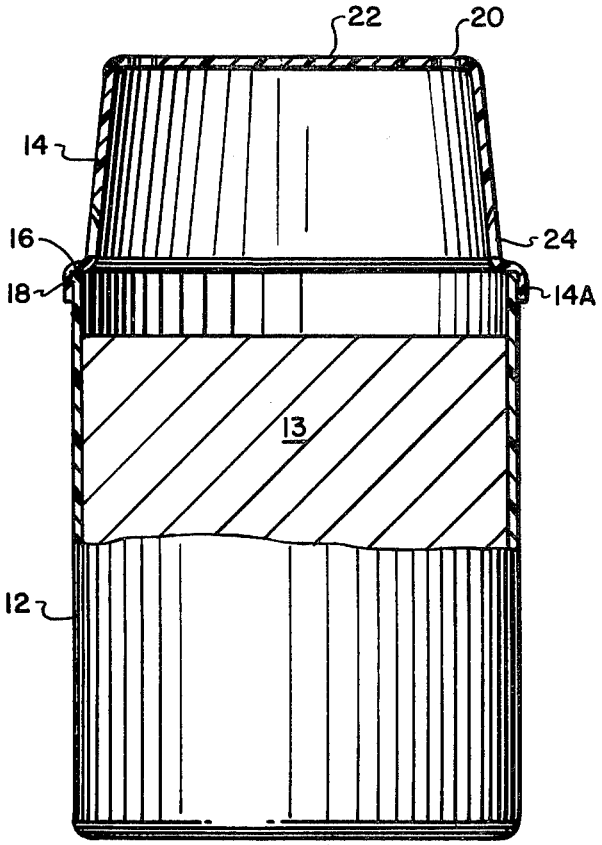
FIG. 3 is a broken away elevational view of the cleaning device.
Figure 2:
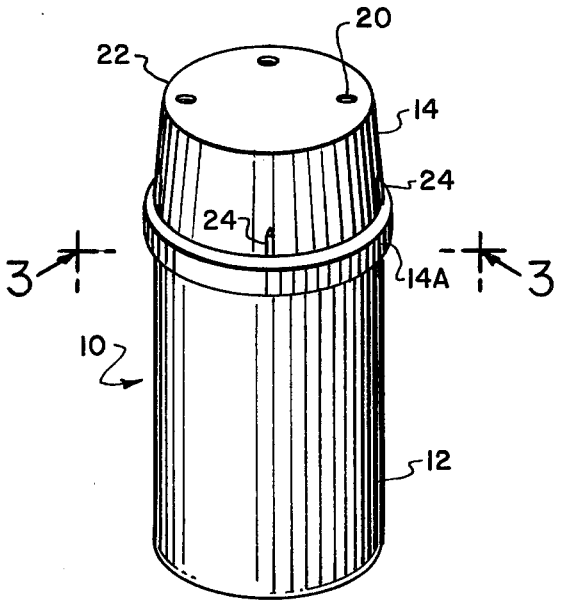
FIG. 2 is another perspective view, but from the opposite, or 180° rotated, perspective.

It will be seen, particularly by reference to FIGS. 1 and 2 that there are three apertures or holes 20 extending through the planar top or end wall 22 of the cover 14. These holes 20 are not spaced entirely around the circumference of wall 22, but rather are arranged around one-half of the circumference with equal spacing. Such holes 20 are seen as cylindrical in form. The total area of the three top holes 20 in the exemplary device is approximately 0.0825 square inches, each being approximately 3/16″ in diameter.

In contrast to the holes in the top wall 22, there are three holes 24 in the tapered side wall 26 of the cover 14, each being approximately $3\frac{7}{8}$ inches from the bottom of the container. Although the various dimensions are not critical, the total area of the side holes 24, taken together, is approximately 0.0207 square inches for the illustrative example being discussed. As has already been noted, for the device to operate properly, i.e. with the improved results described, the total square inches of the side holes 24 must be less than the total square inches of the top holes 20. Normally, each of the side holes is identically formed to be slightly less in diameter (approximately 3/32″) than each of the top holes.

By referring to FIG. 2, it will be seen that the three side holes 24 are arranged about the diametrically opposite half of cover 14. This arrangement constitutes a further significant feature of the present invention because it aids in achieving the trapping of air in the container, as will be explained.

It should also be noted that because of the nature of the molding process involving the use of pins to form the holes 24 and because of the way the pins are moved, the teardrop shape illustrated for the side holes 24 is produced. However, there is nothing critical about this shape and typical cylindrical holes could be provided.

It will be appreciated by those skilled in the art that the formulation for the solid material that is held in the container 12 is conventional and comprises urea, synthetic detergents and color. Also, it will be understood that the way in which the cleaners of this type work is that the solid cleaning material (cake) in the container dissolves in water. Being heavier than water, a small amount is skimmed off the top each time the water level in the toilet tank drops and then rises as the tank is being flushed.

Figure 5A:
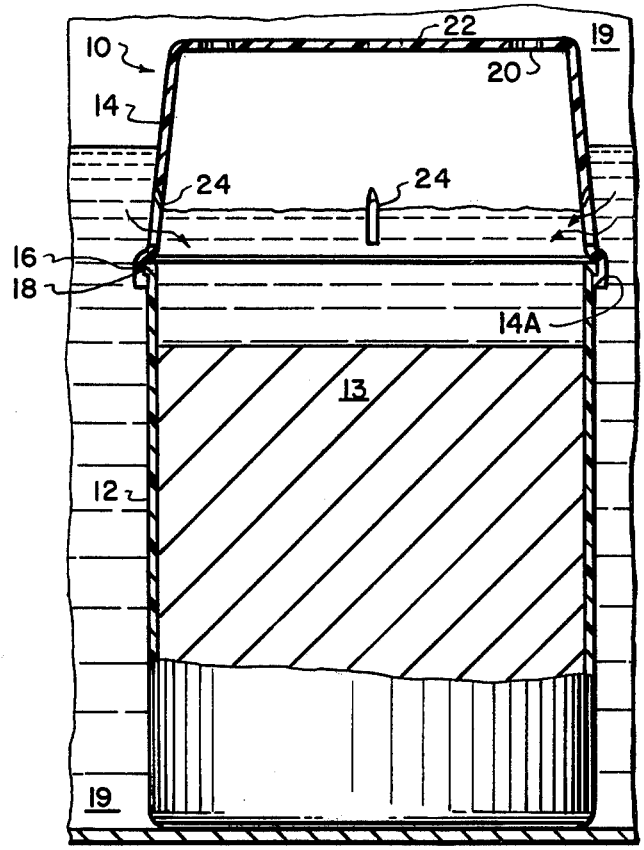
FIGS. 5A through 5C show the operation of the toilet cleaning device as the water in the toilet tank rises.
Figure 5B:
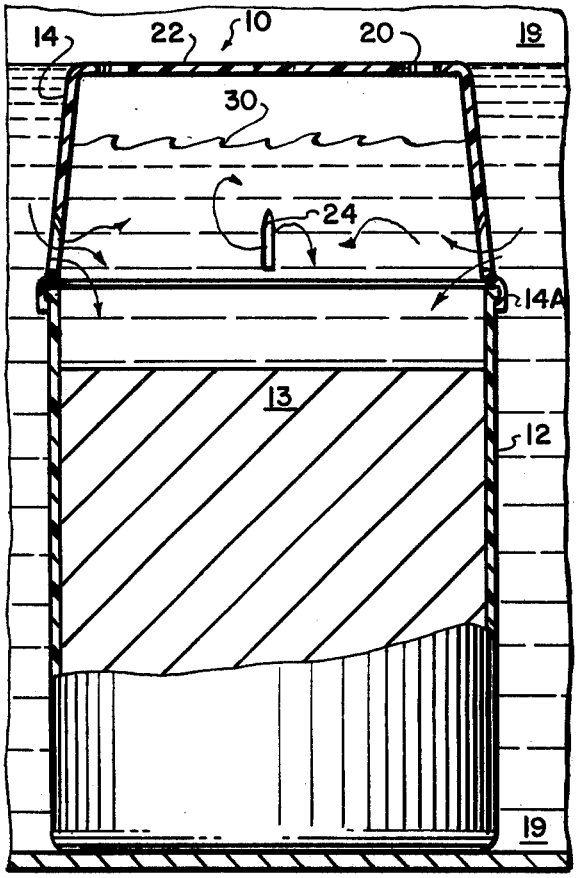
Figure 5C:
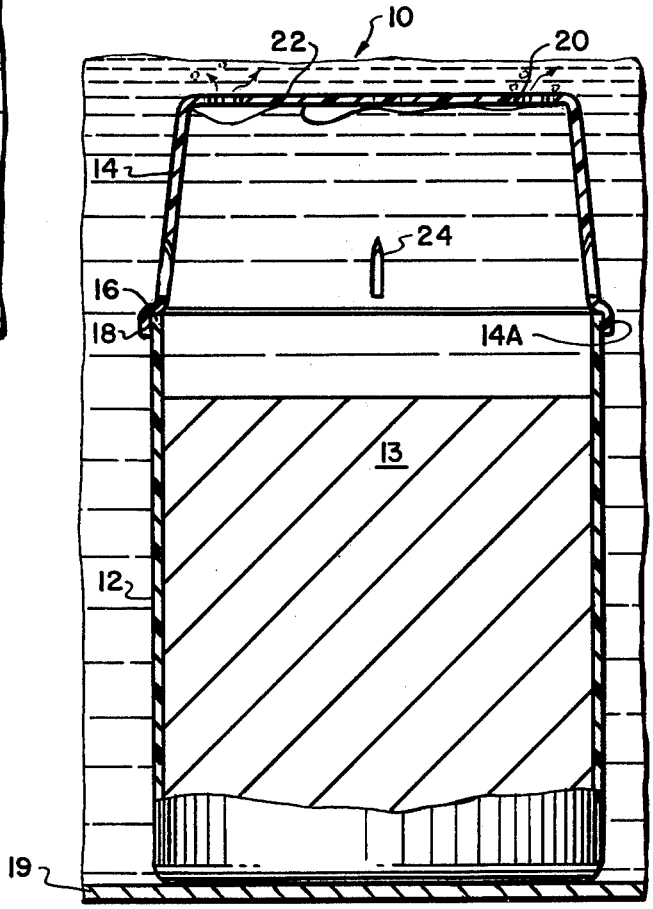

The operation of the toilet bowl cleaning device of the present invention can be appreciated by reference to the progressive stages depicted in FIGS. 5A through 5C of the drawing. When the toilet is flushed and the water level in the tank rises, as for example to the level seen in FIG. 5A, the water enters the device 10 through the side holes 24. Since these side holes are relatively small, i.e., smaller in area in total square inches than the holes 20 in the top of the device, the water level inside device 10 rises more slowly than the water level outside the device. Air is trapped momentarily in the head or top of the device creating a turbulence 30 inside the container (FIG. 5B), which causes a mixing action of the solvent with the cake 13 of cleaning compound inside the container. Since the cake 13 is only partially soluble in water, it is necessary that the turbulence generated be sufficient to lift the solution such that it is then dispensed through the holes 20 in the top of the cover 14 (FIG. 5C).

As noted previously, the holes 24 in the side of the cover 14 are disposed around the diametrically opposite half of the cover from the top holes 20. This arrangement enhances the trapping of air, thereby increasing the mixing action as the water rises in the tank. Such arrangement also partly accounts for the fact previously stated that the water level in the device rises more slowly than the water level in the tank.

When the toilet is flushed again and the water level drops in the tank, the water level outside the device drops faster than the water level inside. This is because the top holes 20 are larger than the side holes 24. Again, this creates turbulence in the device such that additional solution is generated, thence dispensed out the side holes. It will be understood that the described action happens with each flush cycle.

In order to substantiate the claim of superior performance for the cleaning device of the present invention, a physical embodiment according to the invention was tested against a commercially available cleaner that employs the opposite principle, that is, one that has larger side holes than top holes. Both devices were placed in two identical toilet tanks with identical formulas in each container. Each of the formulas consisted of urea, synthetic detergent and blue dye.

Each of the tanks involved in the test was flushed ten times a day for twenty-five days. The light transmittance of the discharge solution was measured after each flush cycle. This transmittance is expressed as a percentage at 610 nanometer on a colorimeter. Thus, the higher percentage of light transmission indicates the lesser concentration of solution.

| Number of Flushes | Our Device | Standard Device |
|---|---|---|
| 5 | 74% transmittance | 76% transmittance |
| 25 | 78% transmittance | 88% transmittance |
| 50 | 78% transmittance | 99% transmittance |
| 100 | 78% transmittance | 81% transmittance |
| 150 | 78% transmittance | 96% transmittance |
| 200 | 78% transmittance | 98% transmittance |
| 250 | 78% transmittance | 99% transmittance |

As will be appreciated, the dispensing by the standard commercial device is not consistent; it being understood that the higher the percentage of transmittance shown, the less the material that is being dispensed. At various times during the test, the standard device dispensed almost nothing (99% transmittance).

What has been disclosed is a toilet bowl cleaning device that yields improved results in consistently dispensing cleaning compound. Such improvement derives from the unique feature of having the series of spaced holes through the top wall of the container cover larger in total area than the total area of the spaced holes extending through the side wall of the cover, while having the top holes arranged in the diametrically opposite half of the cover from the side holes.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. An automatic toilet bowl cleaning device adapted to dispense water-soluble disinfectant into the flushing water of a toilet tank comprising:

(a) a container for the disinfectant;

(b) a cover, consisting of a single shell, fitted on the container, said cover having a top wall and a side, or peripheral, wall; a first series of at least three spaced holes extending through the top wall of said cover and a second series of at least three spaced holes extending through the side, or peripheral, wall of said cover;

(c) the total area of all of the spaced holes of the second series being less then the total area of all of the spaced holes of the first series, all of the spaced holes of the second series being arranged solely in one-half of the cover, while all of the spaced holes of the first series are arranged solely in the diametrically opposite half of the cover;

(d) whereby the disinfectant solution formed within the container is consistently dispensed due to the increased mixing action of the solvent with the solid disinfectant.

2. A device as defined in claim 1, in which the ratio of the total area of all of the first series of spaced holes to the total area of all of the second series of spaced holes is approximately four to one.

3. A device as defined in claim 2, in which the total area of the first series of spaced holes is approximately 0.0825 square inches and the area of the second series is approximately 0.0207 square inches.

4. A device as defined in claim 1, in which the total height of the device is approximately five inches, the diameter at the base is approximately $2\frac{3}{4}$ inches, and the diameter at the top is approximately 2 7/16 inches.

5. A device as defined in claim 4, in which the side holes are located approximately $3\frac{7}{8}$ inches from the bottom of said container.

* * * * *